US005171143A

United States Patent [19]

Sohn

[11] Patent Number: 5,171,143

[45] Date of Patent: Dec. 15, 1992

[54] SAFETY LIGHTER WITH PIVOTABLE ACTUATING MEMBER

[75] Inventor: Jin-Chang Sohn, Busan City, Rep. of Korea

[73] Assignee: Myung Sung Ltd., Rep. of Korea

[21] Appl. No.: 765,439

[22] Filed: Sep. 25, 1991

[51] Int. Cl.[5] ..... F23D 11/36

[52] U.S. Cl. ..... 431/153; 431/255

[58] Field of Search ..... 431/152, 153, 255, 254, 431/344, 277, 151, 150, 267

[56] References Cited

U.S. PATENT DOCUMENTS

| | | | |
|---|---|---|---|
| 3,466,135 | 9/1969 | Rabe | 431/152 |
| 3,724,993 | 4/1973 | Goto | 431/255 |
| 3,734,680 | 5/1973 | Maruyama | 431/255 |
| 3,764,256 | 10/1973 | Moriya | 431/255 |
| 3,824,064 | 7/1974 | Chevallier | 431/255 |
| 3,898,031 | 8/1975 | Rusakowicz | 431/254 |
| 4,179,260 | 12/1979 | Lowenthal | 431/255 |
| 4,487,570 | 12/1984 | Lowenthal | 431/153 |
| 4,859,172 | 8/1989 | Nitta | 431/153 |
| 4,904,180 | 2/1990 | Nitta | 431/153 |
| 4,921,420 | 5/1990 | Johnston | 431/153 |

*Primary Examiner*—James C. Yeung
*Attorney, Agent, or Firm*—Klauber & Jackson

[57] ABSTRACT

A safety lighter includes a fuel supply chamber which holds a supply of ignitable gas, a fuel supply nozzle/-valve arrangement which supplies the ignitable gas from the chamber to an ignition location; a piezoelectric assembly for generating an electric spark; a wire electrode for supplying the electric spark to the ignition location; a spring-loaded plunger for actuating the piezoelectric element upon depression thereof; an actuating button for depressing the plunger to supply the electric spark to the ignition location; a pivot pin mounted to the actuating button to permit rotation of the actuating button about an axis thereof between an inoperable position at which the button cannot actuate the piezoelectric element and an operable position at which the button can actuate the piezoelectric element; an elongated slot in the housing for guiding the pivot pin and actuating button in a reciprocable manner between an inactive position at which the actuating button does not actuate the piezoelectric element and an active position at which the actuating button actuates the piezoelectric element to ignite the gas at the ignition location, only when the actuating button is pivoted to the operable position; a coil spring which biases the plunger into engagement with the actuating button to bias the actuating button to the inactive position when the actuating button is in the operable position; and the actuating button being exposed at all times when the actuating button is in the inoperable and the operable positions to permit manual pivotal movement therebetween.

12 Claims, 2 Drawing Sheets

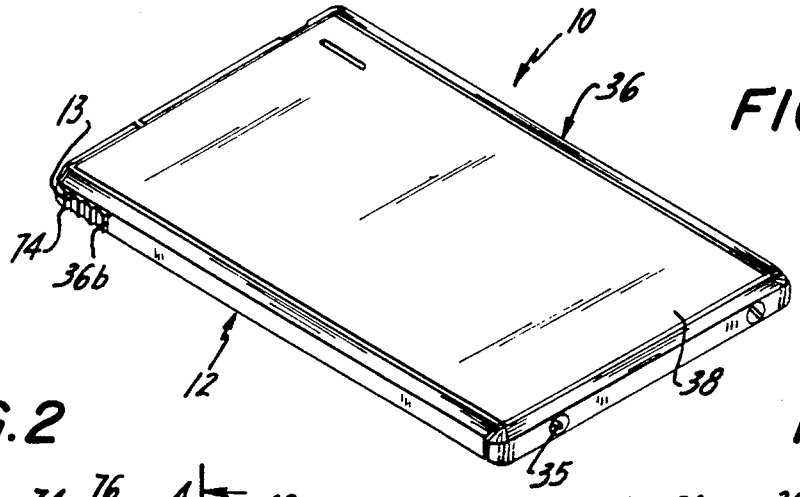
FIG. 1
FIG. 2
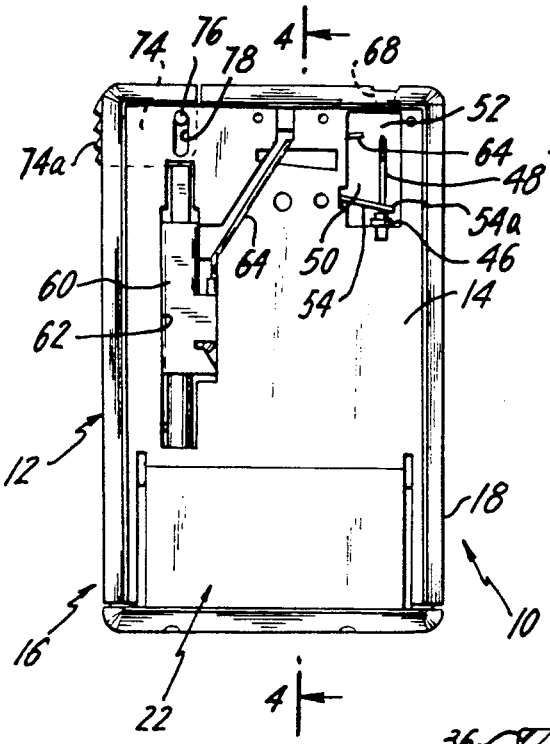
FIG. 3
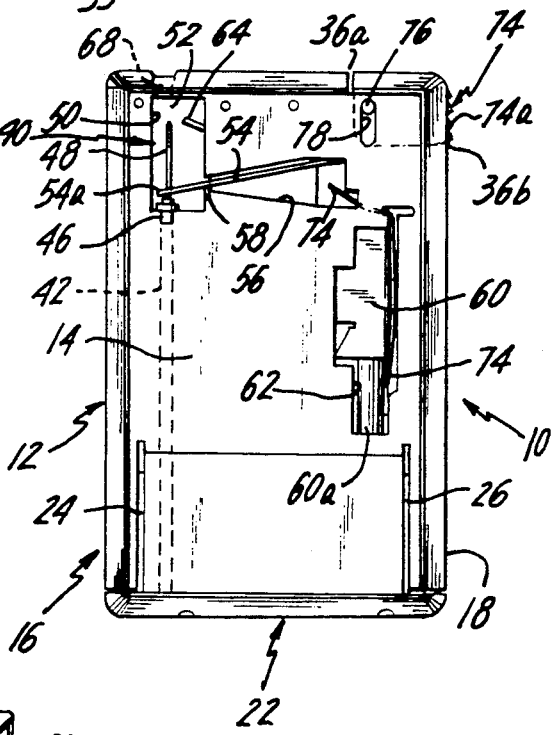
FIG. 4
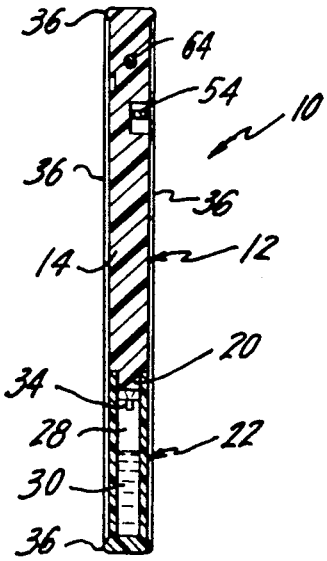

SAFETY LIGHTER WITH PIVOTABLE ACTUATING MEMBER

BACKGROUND OF THE INVENTION

The present invention relates to small, pocket-held butane lighters for cigarettes and the like, and more particularly, is directed to a butane lighter having a mechanism for preventing unintentional and accidental activation.

Many conventional push-button butane lighters use a piezoelectric ignition system. In such a system, the user depresses a push-button which is maintained in a reciprocable position. Depression of the push-button initiates a gas flow and simultaneously activates the piezoelectric ignition system to produce a spark in an area to which the gas is fed. The spark thus generated causes ignition of the gas, which continues as long as the user depresses the push-button to supply the gas.

However, such a piezoelectric butane lighter is susceptible to misuse by children who are able to activate the lighter relatively easily. Additionally, such piezoelectric lighters could accidentally be ignited in the purse or pocket of the owner by some other object therein pressing against the push-button to a sufficient extent to activate the piezoelectric ignition system.

Accordingly, it is desirable to develop a butane lighter having a piezoelectric ignition system, which can be disabled or made inactive, thereby preventing such accidental or unintentional ignition. At the same time, this objective must be achieved without hampering a user's ability to intentionally unlock and activate the lighter with a minimum of difficulty, that is, typically with one hand and with as little manipulation as is necessary.

U.S. Pat. No. 4,921,420 to Johnston discloses a child-resistant, disposable lighter having a grind wheel and flint type of ignition system, and which provides a means for preventing operation of the actuation lever. Although the lighter disclosed by Johnston may be difficult for children to operate, and may even deter accidental ignition, it is also relatively difficult for an adult to intentionally activate the device. Further, the lighter is relatively complex in construction due to the additional means, thereby adding substantially to the cost thereof.

U.S. Pat. No. 4,904,180 to Nitta discloses a gas lighter equipped with a locking means to prevent undesired ignition. The locking means generally comprises a U-shaped stopper which is slidably fitted to the top of a thumb-pusher by fitting its inside ridges in corresponding notches made on the three sides of the thumb pusher. A hook-shaped leaf spring biases the stopper so that the thumb-pusher may not be depressed without first sliding the stopper in a first direction. The thumb-pusher may then be depressed, thereby activating the piezoelectric element. When the thumb pusher is released, it automatically springs back, and the leaf spring pushes the stopper back. However, this lighter may still be easily activated by a child. Further, the locking mechanism may not be easily deactivated by the user, since the stopper must be pushed each time until it has reached the unlocked position.

U.S. Pat. No. 4,859,172 to Nitta discloses a piezoelectric lighter equipped with a rotatable hook-shaped safety lock which includes a pivot which can snap-fittingly be received into a circular hole of the casing to prevent actuation of the push-cap. However, this safety lock has an external mechanism which suffers from the disadvantage that foreign objects in a handbag or pocket may dislodge the lock and allow unintentional activation of the lighter. Additionally, this mechanism can be relatively easily manipulated by children. Moreover, engagement of this lock mechanism is accomplished by an action that requires manipulation at a different location on the lighter than the actual ignition thereat by the reciprocable movement of the push cap.

U.S. Pat. No. 4,487,570 to Lowenthal discloses a butane lighter having a piezoelectric ignition system wherein downward operative movement of an actuator slide causes pivoting of a member to create a flame aperture, thus revealing the nozzle of the burner valve and allowing gas to be discharged. Continued downward movement of the actuator slide operates the piezoelectric ignition system for igniting the gas released by the start of the downward motion. However, this lighter has no security lock mechanism, thereby permitting children the opportunity to tamper therewith.

U.S. Pat. No. 4,179,260 to Lowenthal provides a lighter having a piezoelectric ignition system. The lighter is provided with a lid and the actuation member of the piezoelectric ignition system is inaccessible as long as the lid is closed. The most relevant aspect of this invention is the embodiment of FIGS. 13–18 in which the depressible actuating member is pivoted about a hinge. A compression spring acts on a portion of the actuating member below the hinge in order to urge the serrated part of the actuating member down into the confines of the casing. When the lid is open, the lid causes a cam member to swing upward and ride over a surface of the actuating member, causing it to pivot against the action of the spring and so as to provide accessibility for application of the operator's thumb. Although this embodiment discloses a pivoting actuating member, it is very complicated since it requires a spring to normally bias the actuating member to its closed or inoperative position and a cam mechanism with a lid to move the actuator to its operative position. However, no provision is made to prevent a child from opening the cover, and upon opening the cover, from actuating the piezoelectric ignition system by simply depressing the actuating button. Additionally, it is still possible that the lid of the butane lighter could be opened while inside a pocketbook, thereby exposing the actuating member to possible depression by some other object therein.

U.S. Pat. No. 3,898,031 to Rusakowicz discloses a gas fueled safety lighter. The safety feature of this lighter relates to a head assembly which can be moved out of the way to permit the gas to escape. However, this lighter is not designed for use with a piezoelectric ignition system and the safety mechanism cannot be disabled when desired.

U.S. Pat. No. 3,466,134 to Rabe discloses a lighter having an actuating member which is movable between an inactive or inoperative position and an active or operative position when depressed. The actuating member is coupled through a linkage to the cap member so as to pivot the cap member open above the gas exit port when the actuating number is depressed. However, there is no provision for an actual locking mechanism nor is there any teaching of how this cover mechanism may be adapted for use with the piezoelectric ignition system in a lighter.

Therefore, there exists a need for the development of a lighter using a piezoelectric ignition system and having a mechanism for preventing the accidental actuation of the ignition system in a pocket or purse. Additionally, the disengaging mechanism should prevent operation of the lighter by children.

OBJECTS AND SUMMARY OF THE INVENTION

Accordingly, it is an object of the present invention to provide a pocket-held butane lighter which cannot accidentally be activated in a user's pocket or purse.

It is another object of the present invention to provide a butane lighter having a piezoelectric ignition system which can be disabled, thereby preventing tampering by children.

It is still another object of the present invention to provide a butane lighter having a piezoelectric ignition system which may be easily and selectively disabled and enabled.

It is yet another object of the present invention to provide a butane lighter having a piezoelectric ignition system and an actuating member which can easily be disabled by the user with minimal additional finger repositioning and manipulation.

It is a further object of the present invention to provide a butane lighter having a piezoelectric ignition system with a reciprocable actuating member that can be pivoted to an inoperative position.

In accordance with an aspect of the present invention, a safety lighter includes fuel supply means for supplying an ignitable gas at an ignition location; ignition means for igniting the gas at the ignition location; actuating means for actuating the ignition means to ignite the gas at the ignition location; pivot means for permitting rotation of the actuating means about an axis of the pivot means between an inoperable position at which the actuating means does not actuate the ignition means and an active position at which the actuating means can actuate the ignition means; guide means for guiding the actuating means in a reciprocable manner between an inactive position at which the actuating means does not actuate the ignition means and an operable position at which the actuating means actuates the ignition means to ignite the gas at the ignition location, only when the actuating means is pivoted to the operable position; biasing means for biasing the actuating means to the inactive position when the actuating means is in the operable position; and the actuating means being exposed at all times when the actuating means is in the inoperable and the operable positions to permit manual pivotal movement therebetween.

The above and other objects, features and advantages of the present invention will become readily apparent from the following detailed description which is to be read in connection with the accompanying drawings.

BRIEF DESCRIPTION OF THE DRAWINGS

FIG. 1 is a perspective view of a safety lighter with a pivotable actuating member according to one embodiment of the present invention;

FIG. 2 is a front elevational view of one side of the safety lighter of FIG. 1, with the front cover panel thereof removed;

FIG. 3 is a rear elevational view of the other side of the safety lighter of FIG. 1, with the rear cover panel thereof removed;

FIG. 4 is a cross-sectional view of the safety lighter of FIG. 2, taken along line 4—4 thereof;

DETAILED DESCRIPTION OF A PREFERRED EMBODIMENT

Figure 5:
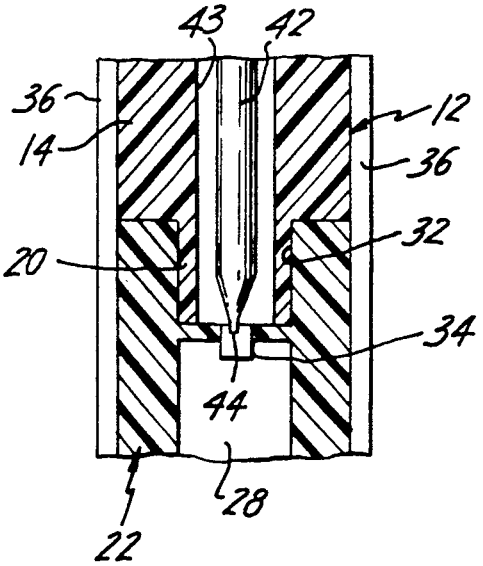
FIG. 5 is an enlarged cross-sectional view, similar to FIG. 4, of a portion of the safety lighter of FIG. 2.

Referring to the drawings in detail, a butane lighter 10 according to the present invention includes a plastic housing 12 formed by a rectangular portion 14 having two parallel, spaced legs 16 and 18 depending from lower ends of the longer sides of rectangular portion 14 and formed integrally therewith. In this manner, an open area is defined between the lower edge 14*a* of rectangular portion 14 and the inner edges of legs 16 and 18. Further, the lower end of rectangular portion 14 is formed with a reduced width section 20, as best shown in FIGS. 4 and 5.

A fuel supply cartridge 22 is inserted within the aforesaid opening defined within housing 12. In this regard, the inner surfaces of legs 16 and 18 are formed with channels or tracks (not shown), and cartridge 22 which has a generally rectangular configuration has opposite guides 24 and 26 slidably received within the channels or tracks of legs 16 and 18. Fuel supply cartridge 22 defines a hollow chamber 28 therein which holds an ignitable gas 30 such as butane fuel. In this regard, the side walls of cartridge 22 extend past the upper closed end thereof so as to define a recess 32 which frictionally receives the reduced width section 20 of rectangular portion 14 of housing 12 in order to retain fuel supply cartridge 14 within the aforementioned opening of housing 12. As will be discussed hereinafter, the upper wall of cartridge 22 that defines chamber 28, includes a needle valve 34 (schematically shown) or the like which permits access to butane fuel 30 upon depression thereof.

In addition, the lower end of cartridge 22 can contain a refill valve 35 for refilling cartridge 22 with the butane fuel upon depletion thereof, in a conventional manner. Alternatively, cartridge 22 can be removed and replaced with a new cartridge.

As also shown in the drawings, combined housing 12 and cartridge 22 include a rectangular peripheral border 36 which is wider than the remainder of housing 12, as shown best in FIGS. 4 and 5. As a result, a slightly recessed rectangular area is formed at opposite faces of housing 12 within border 36. Rectangular cards 38 can be adhesively secured within the recessed areas defined within border 36 on each side of housing 12 to cover the internal mechanisms thereof, which will be described hereinafter. In addition, cards 38 can contain various advertising messages.

A fuel supply assembly 40 is provided in rectangular portion 14 of housing 12 and includes a fuel supply tube 42 within an opening 43 in housing 12. Fuel supply tube 42 includes a needle 44 (shown schematically in FIG. 5) at the lower end thereof which opens needle valve 34 to provide fluid communication between chamber 28 and fuel supply tube 42, when cartridge 22 is assembled with housing 12. The upper end of fuel supply tube 42 is connected with a valve assembly 46 having a nozzle 48 disposed thereabove for supplying the ignitable gas 30 at an ignition location 52. Valve assembly 46 and nozzle 48 are provided in an open area 50 of housing 12. With this arrangement, nozzle 48 is movable in the upward direction of FIG. 3 against the force of a spring (not shown) housed internally within valve member 46. Normally, nozzle 48 is biased downwardly by the spring to its closed position to block the supply of butane fuel to ignition location 52.

In this regard, a lever arm 54 has a fork end 54*a* connected with nozzle 48 in order to move nozzle 48 upwardly against the force of the aforementioned spring in valve assembly 46. Lever arm 54 extends within a recess 56 of rectangular portion 14 of housing 12, recess 56 being contiguous and in open communication with open area 50 of housing 12 which contains valve member 46 and nozzle 48. As shown best in FIG. 3, while open area 50 extends entirely through housing 12, recess 56 extends only partially through housing 12. Housing 12 further includes a fulcrum 58 at the intersection of open area 50 with recess 56, upon which lever arm 54 rests and which functions as a pivot point for lever arm 54. Accordingly, when the opposite end 54*b* of lever arm 54 is moved downwardly, fork end 54*a* thereof moves upwardly, thereby moving nozzle 48 upwardly so as to open valve member 46 to permit the supply of butane fuel to ignition location 52.

Butane lighter 10 further includes a conventional piezoelectric element 60 mounted within an open area 62 of housing 12. Piezoelectric member 60 is constructed, as is conventional, to create a spark which is transmitted along a wire electrode 64 extending therefrom and which terminates at ignition location 52 in order to ignite the butane fuel supplied to ignition location 52 from nozzle 48. As a result, a flame 66 is created which extends through an upper opening 68 of housing 12.

Piezoelectric element 60 includes a depressible actuating plunger 70 which is spring biased upwardly to the position shown in FIG. 2, by a coil spring 72 positioned therebelow within piezoelectric element 60. The lower end of actuating plunger 70 is provided with an actuating post 70*a* which, when depressed along with actuating plunger 70, extends within the main body of piezoelectric element 60, to create a spark at the end of wire electrode 64. Plunger 70 is positioned immediately adjacent the opposite free end 54*b* of lever arm 54. As discussed above, the aforementioned piezoelectric element 60 is of a conventional nature.

Further, a metal wire spring-like element 75 which extends along piezoelectric element 60, has one end in contact with the lower metal post 60*a* of piezoelectric element 60 and the opposite end positioned immediately below opposite free end 54*b* of lever arm 54 so as to be in contact therewith when the opposite free end 54*b* of lever arm 54 is moved downwardly.

In accordance with an important aspect of the present invention, an actuable button 74 of a generally rectangular configuration is provided within an upper corner of housing 12 and is provided with opposite pivot pins 76 extending from opposite sides thereof. Pivot pins 76 extend through vertical elongated slots 78 in opposite sidewalls of housing 12 for vertical and rotational movement therein. In addition, housing 12 includes an opening 13 at the outer periphery of border 36 extending from point 36*a* to point 36*b* thereof to permit rotational movement of actuable button 74 from the inoperable position of FIG. 3 to the operable position of FIG. 7, and to permit reciprocable movement between the upper, dashed line inactive position of FIG. 7 and the lower, solid line active position of FIG. 7.

Figure 7:
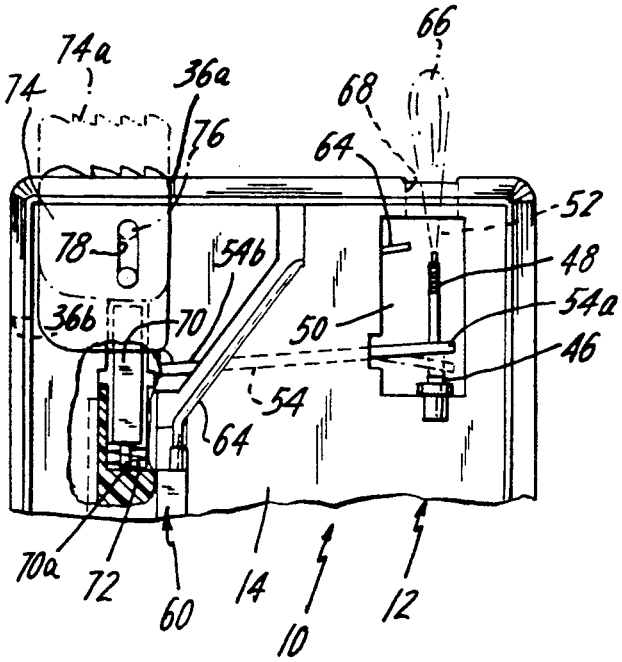
FIG. 7 is an enlarged, partially broken away, view of a portion of the safety lighter of FIG. 2, showing movement of the actuating member to its active actuating position.

Specifically, when actuable button 74 is in the operable position shown in FIG. 7, actuating plunger 70 is normally biased to its upward dashed line position therein. Specifically, the upper end of actuating plunger 70 abuts the lower edge of actuatable button 74 to bias the same upwardly to the dashed line position of FIG. 7. In such case, when the user exerts a downward force against actuatable button 74, actuatable button 74 is moved to the solid line position of FIG. 7 against the force of coil spring 72, thereby also depressing actuating plunger 70 and actuating post 70*a* thereof in order to activate piezoelectric element 60 to create a spark at the free end of wire electrode 64. At the same time, the lower edge of actuatable button 74 presses down the opposite free end 54*b* of lever arm 54 so as to cause the supply of butane fuel to ignition location 52. As a result, the butane fuel at ignition location 52 is ignited by the spark to create flame 66 which remains as long as there is a supply of butane fuel to ignition location 52, that is, as long as actuatable button 74 remains in its depressed solid line position of FIG. 7.

Upon release of actuatable button 74, coil spring 72 biases actuating plunger 70, and thereby actuatable button 74, upwardly to the dashed line position of FIG. 7, until pivot pins 76 hit against the upper ends of slots 78. In such position, opposite free end 54*b* of lever arm 54 is no longer depressed, and accordingly, the spring (not shown) within valve member 46 forces nozzle 48 downwardly to close valve member 46 and thereby prevent the supply of butane fuel to ignition location 52. As a result, lever arm 54 is pivoted in the clockwise direction of FIG. 7, since fork end 54*a* thereof is connected with nozzle 48.

Figure 6:
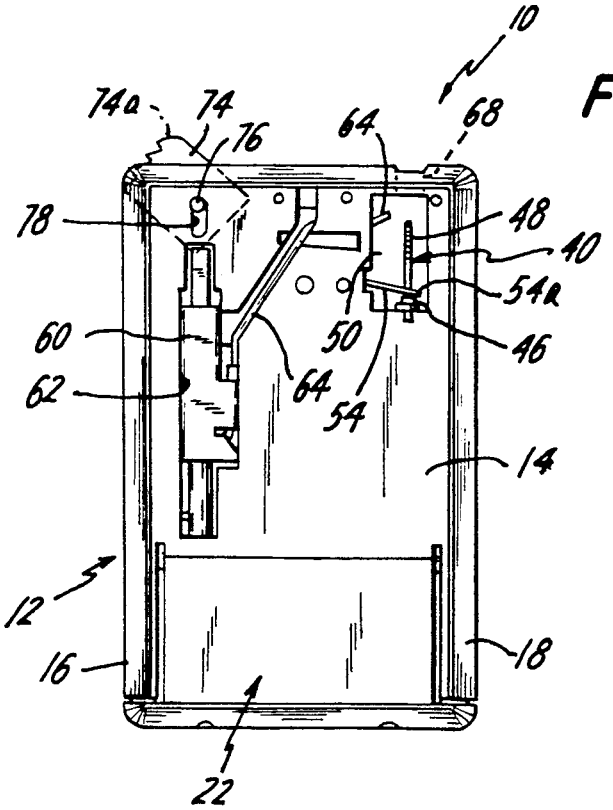
FIG. 6 is a front elevational view of the safety lighter, similar to FIG. 2, with the slidable actuating member partially pivoted between its operable and inoperable positions.

In accordance with the present invention, however, actuatable button 74 is pivotable about pivot pins 76 from the operable position of FIG. 7 to the inoperable position of FIGS. 2 and 3. This rotational motion is shown in FIG. 6. It will be appreciated that, at all times during this pivoting motion, because there is no external downward force on actuatable button 74, coil spring 72 and actuating plunger 70 always bias actuatable button 74 upwardly so that pivot pins 76 are always in engagement with the upper ends of slot 78 to provide a fixed axis of rotation for pivotable movement of actuatable button 74 from its operable position of FIG. 7 to its inoperable position of FIGS. 2 and 3, and vice versa.

In the inoperable position of FIGS. 2 and 3, because of the rectangular nature of actuatable button 74, the upper edge thereof is inaccessible by the user, that is, the upper edge thereof is flush with border 36, and therefore cannot be depressed in order to activate piezoelectric element 60. Specifically, because the serrated edge 74*a* thereof, which is at the upper edge when actuatable button 74 is in the operable position of FIG. 7, is positioned within the side portion of border 36 in the inoperable position of FIGS. 2 and 3, border 36 itself prevents depression of actuatable button 74. As a result, accidental depression of button 74 is prevented with the present invention, by a simple pivoting action of actuatable button 74 to the inoperable position of FIGS. 2 and 3. Since a child generally does not recognize the pivoting nature of actuatable button 74, the child will not accidentally depress button 74 to operate butane lighter 10. In addition, in the inoperable position of FIGS. 2 and 3, button 74 cannot accidentally or inadvertently be operated in a purse or pocket. This is accomplished without the need for any lid or other safety mechanism, as is conventional with butane lighters.

Having described a specific preferred embodiment of the present invention, it will be appreciated that the present invention is not limited to that precise embodiment, and that various changes and modifications can be effected therein by one of ordinary skill in the art without departing from the spirit or scope of the invention as defined by the appended claims.

What is claimed is:

1. A safety lighter comprising:

fuel supply means for supplying an ignitable gas at an ignition location;

ignition means for igniting the gas at said ignition location;

actuating means for actuating said ignition means to ignite the gas at said ignition location;

pivot means for permitting rotation of said actuating means about an axis of said pivot means between an inoperable position at which said actuating means cannot be moved whereby it cannot actuate the ignition means and an operable position at which said actuating means can move to actuate the ignition means;

guide means for guiding said actuating means in a reciprocable manner between an inactive position at which said actuating means does not actuate said ignition means and an active position at which said actuating means actuates said ignition means to ignite the gas at said ignition location, only when said actuating means is pivoted to said operable position;

biasing means for biasing said actuating means to said inactive position when said actuating means is in said operable position; and said actuating means being exposed at all times when said actuating means is in said inoperable and said operable positions to permit manual pivotal movement therebetween.

2. A safety lighter according to claim 1, wherein said ignition means includes piezoelectric means for supplying an electrical spark at said ignition location.

3. A safety lighter according to claim 1, wherein said ignition means includes electric spark generating means for generating an electric spark, wire electrode means for supplying said electric spark to said ignition location, and plunger means for activating said electric spark generating means to generate said electric spark.

4. A safety lighter according to claim 3, wherein said biasing means includes spring means for biasing said plunger means away from said electric spark generating means and into continuous contact with said actuating means so as to bias said actuating means to said inactive position when said actuating means is in said operable position.

5. A safety lighter according to claim 4, further including housing means for containing said fuel supply means, ignition means, actuating means, pivot means, guide means and biasing means.

6. A safety lighter according to claim 5, wherein said pivot means includes at least one pivot pin means connected with said actuating means for permitting rotation of the actuating means about said axis of said pivot means, and said guide means includes at least one elongated slot means in a wall of said housing means for guiding said at least one pivot pin means and said actuating means in said reciprocable manner.

7. A safety lighter according to claim 6, wherein said housing means further includes a peripheral wall having an opening therein for permitting rotation of said actuating means about the axis of said pivot means so that said actuating means is exposed at all times through said opening in the peripheral wall when said actuating means is in said inoperable and said operable positions, so as to permit manual pivotal movement therebetween.

8. A safety lighter according to claim 6, wherein said spring means of said ignition means normally biases said at least one pivot pin means to an extreme position in said at least one slot means of said guide means.

9. A safety lighter according to claim 6, wherein said actuating means includes a substantially rectangular actuating button and said at least one pivot pin means is connected with said actuating button at a position off-center therefrom.

10. A safety lighter according to claim 1, wherein said fuel supply means includes a fuel supply chamber for containing said fuel, nozzle means for supplying said ignitible gas from said fuel supply chamber to said ignition location, valve means connected between said nozzle means and said fuel supply chamber for selectively permitting the supply of said fuel to said ignition location through said nozzle means, and lever means connected with said nozzle means for opening said valve means upon pivoting motion thereof in a first direction.

11. A safety lighter according to claim 10, wherein said lever means is mounted within said housing, and has one end connected with said nozzle means and an opposite free end positioned below said actuating means such that said actuating means moves said opposite free end of said lever means during movement of said actuating means to said active position, so as to open said valve means in order to supply said ignitible gas through said nozzle means to said ignition location.

12. A safety lighter comprising:

fuel supply means for supplying an ignitable gas at an ignition location;

ignition means for igniting the gas at said ignition location;

actuating means for actuating said ignition means to ignite the gas at said ignition location;

pivot means connected with said actuating means for permitting rotation of said actuating means about an axis of said pivot means between an inoperable position at which said actuating means does not actuate the ignition means and an operable position at which said actuating means can actuate the ignition means;

guide means for guiding said actuating means in a reciprocable manner between an inactive position at which said actuating means does not actuate said ignition means and an active position at which said actuating means actuates said ignition means to ignite the gas at said ignition location, only when said actuating means is pivoted to said operable position, said guide means including at least one elongated slot means in a wall of said housing means for guiding said at least one pivot means and said actuating means in said reciprocable manner;

biasing means for biasing said actuating means to said inactive position when said actuating means is in said operable position; and said actuating means being exposed at all times when said actuating means is in said inoperable and said operable positions to permit manual pivotal movement therebetween.

* * * * *